US007666566B2

(12) United States Patent
Ohtani et al.

(10) Patent No.: US 7,666,566 B2
(45) Date of Patent: Feb. 23, 2010

(54) ELECTROPHOTOGRAPHIC TONER AND METHOD OF PREPARING THE TONER

(75) Inventors: Shinji Ohtani, Shizuoka-ken (JP); Hiroshi Yamashita, Numazu (JP); Yohichiroh Watanabe, Fuji (JP); Tsunemi Sugiyama, Yokohama (JP); Takuya Saito, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 409 days.

(21) Appl. No.: 11/029,453

(22) Filed: Jan. 6, 2005

(65) Prior Publication Data

US 2005/0196691 A1 Sep. 8, 2005

(30) Foreign Application Priority Data

Jan. 6, 2004 (JP) ..... 2004-001077

(51) Int. Cl.
*G03G 9/113* (2006.01)

(52) U.S. Cl. ..... 430/137.17

(58) Field of Classification Search ..... 430/108.1, 430/108.14, 108.6
See application file for complete search history.

(56) References Cited

U.S. PATENT DOCUMENTS

| | | | | |
|---|---|---|---|---|
| 4,411,975 | A | 10/1983 | Lu et al. | |
| 5,139,915 | A * | 8/1992 | Moffat et al. | 430/110.2 |
| 5,368,972 | A * | 11/1994 | Yamashita et al. | 430/137.11 |
| 5,541,031 | A | 7/1996 | Yamashita et al. | |
| 5,576,393 | A | 11/1996 | Yamashita et al. | |
| 6,346,356 | B1 * | 2/2002 | Ohno et al. | 430/108.2 |
| 6,964,835 | B2 * | 11/2005 | Hasegawa et al. | 430/108.3 |
| 2003/0077536 | A1 * | 4/2003 | Yamashita et al. | 430/110.3 |
| 2004/0137344 | A1 | 7/2004 | Yamashita et al. | |
| 2004/0185365 | A1 | 9/2004 | Saito et al. | |
| 2005/0003288 | A1 | 1/2005 | Sugiyama et al. | |
| 2005/0196691 | A1 | 9/2005 | Ohtani et al. | |

FOREIGN PATENT DOCUMENTS

| | | |
|---|---|---|
| JP | 56-6247 | 1/1981 |
| JP | 58-186752 | 9/1991 |
| JP | 3-287276 | 12/1991 |
| JP | 5/281852 | 10/1993 |
| JP | 6-313995 | 11/1994 |
| JP | 07-152202 | 6/1995 |
| JP | 9-50150 | 2/1997 |

(Continued)

OTHER PUBLICATIONS

U.S. Appl. No. 11/519,893, filed Sep. 13, 2006, Inoue, et al.

(Continued)

*Primary Examiner*—Mark F Huff
*Assistant Examiner*—Peter L Vajda
(74) *Attorney, Agent, or Firm*—Oblon, Spivak, McClelland, Maier & Neustadt, L.L.P.

(57) ABSTRACT

A method of preparing a toner in an aqueous medium, including:

preparing a dispersion or an emulsion of a toner composition comprising a resin including a carboxyl group and a colorant; and mixing an aromatic compound having a carboxyl group with the dispersion or emulsion, such that the carboxyl group on a surface of the toner is connected with the carboxyl group of the aromatic compound by hydrogen bonding.

16 Claims, 2 Drawing Sheets

FOREIGN PATENT DOCUMENTS

| | | |
|---|---|---|
| JP | 11-084726 | 3/1999 |
| JP | 11-149179 | 6/1999 |
| JP | 11-237767 | 8/1999 |
| JP | 11-242357 | 9/1999 |
| JP | 11-311878 | 11/1999 |
| JP | 2001-305789 | 11/2001 |
| JP | 2001-305797 | 11/2001 |
| JP | 2001-343786 | 12/2001 |
| JP | 2002-82484 | 3/2002 |
| JP | 2003-91100 | 3/2003 |
| JP | 2003-280269 | 10/2003 |

OTHER PUBLICATIONS

U.S. Appl. No. 11/513,175, filed Aug. 31, 2006, Ohki, et al.
U.S. Appl. No. 11/487,374, filed Jul. 17, 2006, Yamashita, et al.
U.S. Appl. No. 11/376,286, filed Mar. 16, 2006, Ohtani.
U.S. Appl. No. 11/851,475, filed Sep. 7, 2007, Watanabe, et al.
U.S. Appl. No. 11/857,999, filed Sep. 19, 2007, Yamashita, et al.
U.S. Appl. No. 12/047,437, filed Mar. 13, 2008, Kuramoto, et al.
U.S. Appl. No. 12/297,952, filed Oct. 21, 2008, Iwamoto, et al.
U.S. Appl. No. 11/219,740, filed Sep. 7, 2005, Sugiyama, et al.
U.S. Appl. No. 11/229,748, filed Sep. 20, 2005, Yamashita, et al.

* cited by examiner

ELECTROPHOTOGRAPHIC TONER AND METHOD OF PREPARING THE TONER

BACKGROUND OF THE INVENTION

1. Field of the Invention

The present invention relates to a toner, particularly for use in a developer for developing an electrostatic latent image by electrophotography, electrostatic recording, electrostatic printing and the like, and to a method of preparing the toner.

2. Discussion of the Background

In electrostatic latent image formation in the methods of electrophotography, electrostatic recording, electrostatic printing and the like, a developer is adhered to an image bearer, such as a photoreceptor on which an electrostatic latent image is formed in the development process. The developer is then transferred therefrom onto a transfer medium, such as a transfer paper, in a transfer process; and then fixed on the transfer medium in a fixing process. The developer can be generally a two-component developer formed of a carrier and a toner; or a one-component developer without a carrier, i.e., a magnetic or a non-magnetic toner, respectively.

Conventionally, a dry toner is formed by kneading a toner binder, such as a styrene resin or a polyester resin, with a colorant upon application of heat to form a kneaded mixture, cooling the mixture to solidify the mixture and pulverizing the solidified mixture.

The particle diameter of the toner is downsized to produce high-definition and high-quality images. However, a toner formed by the conventional kneading and pulverizing method has an amorphous particle form and cannot be classified. This is because ultrafine particles having a strong adherence keep adhering to the toner having a desired particle diameter, even after a classifying process. In an image forming apparatus, such ultrafine particles adhere to a carrier and apparatus parts and are fixed thereon due to being stirred with the carrier in the image developer, and due to contact stress from a developing roller, a toner feeding roller, a layer-thickness regulation blade and/or a frictional-charged blade. In the meantime, fluidizer is buried in the surface of the toner, resulting in deterioration of the quality of the resultant images. In addition, amorphous toner having low fluidity as a powder needs a large amount of fluidizer and the filling rate thereof into a toner bottle is so low that the amorphous toner is one of the impediments to downsizing of the apparatus.

Therefore, toners having a small particle diameter are not yet fully utilized. Further, the kneading and pulverizing method has a particle diameter limit, and is unable to further effectively downsize the particle diameter beyond that limit.

Further, to produce full-color images, the transfer process for transferring an image formed of multiple color toners from a photoreceptor to a transfer medium and a paper is complicated. Because of its poor transferability, amorphous pulverized toner is consumed in a larger amount to achieve the same level of image formation.

Accordingly, demands for reducing the running costs and producing high-definition images, without image omission, by improving transferability of the toner to decrease the consumption thereof, are increasing. This is because better transferability of the toner can dispense with the need for a cleaning unit to remove untransferred toner from a photoreceptor and a transfer medium. Therefore the apparatus can be downsized, the cost can be reduced and there is minimal waste toner. To improve such disadvantages due to the shapes, methods of producing toners having various shapes have been proposed, such as suspension polymerization methods and emulsion polymerization condensation methods.

Japanese Laid-Open Patent Publication No. 7-152202 discloses a polymer dissolution suspension method accompanied with a volume contraction. The method includes dispersing or dissolving toner materials in a volatile solvent, such as a low-boiling organic solvent, to form a dispersion or a solution; emulsifying the dispersion or solution in a water medium including a dispersant, to be a droplet; and removing the volatile solvent therefrom.

Differently from the suspension polymerization methods and emulsion polymerization condensation methods, the polymer dissolution suspension method accompanied with a volume contraction can use general resins such as a polyester resin effectively used for full-color images needing transparency and smoothness after fixed. However, a dispersant used in the method strongly adheres to the surface of the toner and is difficult to remove by washing, and therefore the chargeability of resultant toner deteriorates, i.e., the resultant toner is charged low, slowly charged and strongly affected by humidity.

Japanese Laid-Open Patent Publication No. 11-149179 discloses a method of decreasing the viscosity of the dispersed phase using a low-molecular-weight resin in the polymer dissolution suspension method to make the emulsification easier, and performing an inter-particle polymerization to improve the fixability of the resultant toner. However, when a functional group, particularly an isocyanate compound is used in the inter-particle polymerization, chargeability of the resultant urethane and urea group largely affects the chargeability of the resultant toner.

To solve such problems, Japanese Laid-Open Patent Publication No. 2001-343786 discloses a method of directly preparing a toner by polymerizing a metal oxide of aromatic oxy carboxylic acid, a colorant, a low-softening point material and a composition of polymerizing monomers having a polar resin in a water-medium, wherein the metal oxide of aromatic oxy carboxylic acid, colorant, low-softening point material and polar resin are dispersed in the composition of polymerizing monomers; the metal oxide of aromatic oxy carboxylic acid which is soluble in an alkaline aqueous solution having a pH of from 9 to 13 is further added to the water-medium in a process of polymerization or granulation to perform a polymerization in the water-medium having a pH of from 4.5 to 9.0; the pH thereof is readjusted to have 9 to 13; and the metal oxide of aromatic oxy carboxylic acid is separated out on the surface of the toner by performing an acid treatment in the water-medium having a pH of from 1.0 to 2.5. Although the chargeability of resultant toner improves, the metal oxide of aromatic oxy carboxylic acid freely present on the surface of the toner noticeably contaminates a charging member such as a carrier. The charge quantity of the toner largely deteriorates with time and the toner cannot be practically used.

Japanese Laid-Open Patent Publication No. 11-84726 discloses a method of adding a boric acid aqueous solution or a metal salt aqueous solution to an agglomerate of a latex emulsion having a colorant at 30 to 95° C. to prepare a mixture; adding a salicylic acid or a catechol thereto after adding a base thereto to have a pH of from 9 to 12 to chemically reform the surface of the agglomerate of a latex emulsion. However, only zinc is used in the Examples, and the reaction temperature is as high as 85° C.

In this case, the zinc sulfate is a bivalent metal and the zinc ion has a tetracoordination, and the unitable salicylic acid or catechol has one molecule. As a result of an investigation of the present inventors, when a unitable organic acid has one molecule, i.e., when a bivalent metal is used, a the resultant toner does no have desired chargeability. Since the salicylic acid is added when the pH is from 9 to 12 and the temperature is as high as from 30 to 95° C. Further, since the pH is maintained until the reaction is completed, the metallic compound cannot be considered to sufficiently react. In addition, it is a problem that a large amount of heat is applied to the toner. Namely, the method is unable to prepare a low-temperature fixable toner having a low glass transition temperature, or take a long time to complete the reaction when the reaction temperature is decreased to 30° C. or less.

For a conventional pulverized toner, a functional organic compound called a charge controlling agent (CCA) is included in a toner composition before kneaded, and the toner composition including the CCA is uniformly dispersed by kneading upon application of heat and is pulverized such that a specific amount of the CCA is present on a surface of the toner to have a desired charge controllability.

Even when the CCA used for the conventional pulverized toner is included in the toner of the present invention, an effect thereof is apparently low and falls far short of a desired target.

It is supposed that this is because when the functional organic compound has a high lipophilic property, the functional organic compound is dispersed in the toner and scarcely present on the surface thereof, and therefore the CCA exerting its effect when present on the surface thereof in a specific amount cannot exert its effect at all or can scarcely exert its effect.

When the functional organic compound has a high hydrophilicity, the functional organic compound gradually moves to an aqueous phase while the toner is prepared, and is supposed to be scarcely present on the surface thereof. In this case, since the functional organic compound is neither present on the surface thereof nor therein, the charge controlling effect is not exerted at all.

It is quite difficult to make the functional organic compound selectively present on the surface of the toner by the conventional technologies, and therefore it is quite difficult to impart a sufficient charge controlling effect thereto.

Because of these reasons, a need exists for a toner having a high average of charged level, a high stability thereof, a high speed of being charged, a sharp particle diameter distribution, a spherical shape, a high melting viscosity, and which is not affected by an environment such as humidity and temperature.

SUMMARY OF THE INVENTION

Accordingly, an object of the present invention is to provide a toner having a high average of charged level, a high stability thereof, a high speed of being charged, a sharp particle diameter distribution, a spherical shape, a high melting viscosity, a high transferability, and which is not affected by an environment such as humidity and temperature, and which reproduces high quality full-color images.

Another object of the present invention is to provide a process cartridge using the toner.

These objects and other objects of the present invention, either individually or collectively, have been satisfied by the discovery of a method of preparing a toner in an aqueous medium, comprising:

dispersing a toner composition comprising a resin including a carboxyl group and a colorant to prepare a dispersion of toner particles; and adding an aromatic compound having a carboxyl group to the dispersion such that a carboxyl group on a surface the toner is connected with the carboxyl group of the aromatic compound by hydrogen bonding.

These and other objects, features and advantages of the present invention will become apparent upon consideration of the following description of the preferred embodiments of the present invention taken in conjunction with the accompanying drawing.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein.

DETAILED DESCRIPTION OF THE INVENTION

Figure 1:
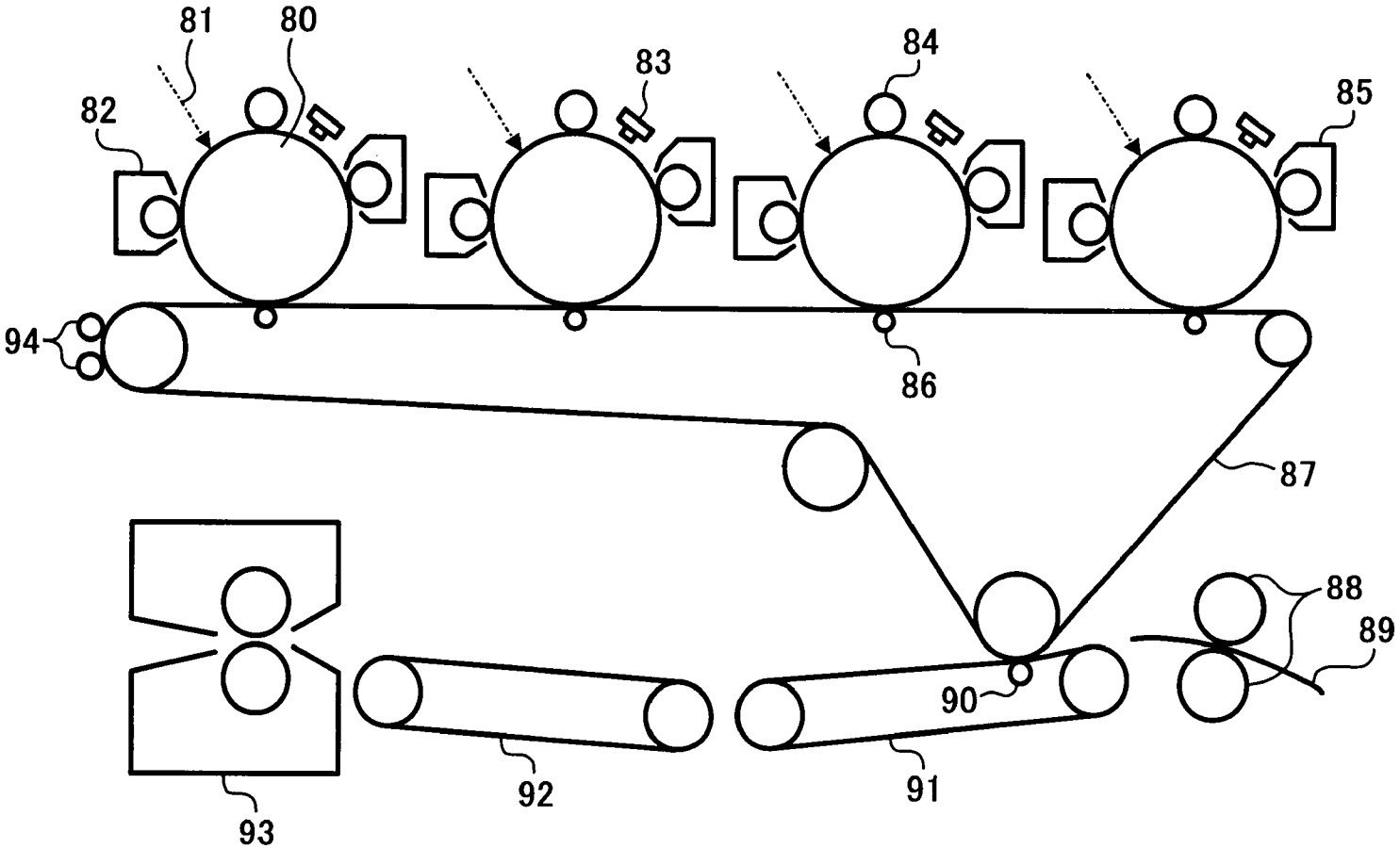
FIG. 1 is a schematic view illustrating the tandem-type full-color image forming apparatus using an intermediate transfer and the toner of the present invention.

The present invention provides a toner having one or more of a high average of charged level, a high stability thereof, a high speed of being charged, a sharp particle diameter distribution, a spherical shape, a high melting viscosity, a high transferability, and which is not affected by an environment such as humidity and temperature, and which reproduces high quality full-color images, most preferably all of these characteristics.

More particularly, the present invention relates to a method of preparing a toner in an aqueous medium, comprising:

dispersing a toner composition comprising a resin including a carboxyl group and a colorant to prepare a dispersion of toner particles; and adding an aromatic compound having a carboxyl group to the dispersion such that a carboxyl group on a surface the toner is connected with the carboxyl group of the aromatic compound by hydrogen bonding.

Hereinafter, the present invention will be explained, but is not limited thereto.

An aromatic carboxylic compound reacted by hydrogen bonding to a surface of a toner is dispersed in water which is 100 times as much as the aromatic carboxylic compound to prepare a dispersion, and an alkali compound such as sodium hydroxide having an equivalent mol to that of the aromatic carboxylic compound is added to the dispersion at room temperature of form 5 to 30° C. to prepare an aromatic carboxylic sodium aqueous solution. Next, after a toner composition is emulsified or dispersed to prepare an emulsion or a dispersion, a precisely measured and desired amount of the aromatic carboxylic sodium aqueous solution is slowly added to the emulsion or dispersion to prepare a slurry. After the slurry is sufficiently stirred, an inorganic acid such as a phosphoric acid is added thereto at room temperature while adjusting a pH thereof.

When the pH varies too quickly, a carboxyl group on a surface of a toner and a carboxylic acid derivative are not connected with each other by hydrogen bonding, and separate out in the slurry. In this case, the carboxylic acid derivative is free in the toner as a crystal particulate material. When such a toner is used, background fouling and carrier contamination occur.

Specific examples of the aromatic carboxylic compound include compounds having the following formulae (1) to (6):

(1)

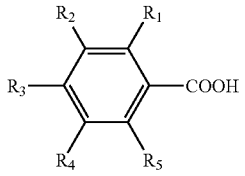

wherein $R_1$ and $R_5$ independently represent an alkyl group having 1 to 12 carbon atoms, an aryl group, a methoxy group, an ethoxy group, a hydrogen atom, a carboxyl group or a hydroxyl group; and $R_2$, $R_3$ and $R_4$ independently represent a halogen atom, a perfluoroalkyl group, a fluoro group, a nitro group, a carboxyl group and a hydrogen atom, and at least one of $R_2$, $R_3$ and $R_4$ is a one of the halogen atom, perfluoroalkyl group, fluoro group and nitro group;

(2)

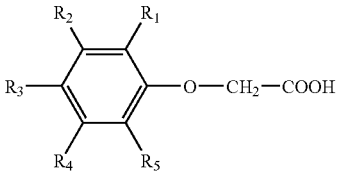

wherein $R_1$ and $R_5$ independently represent an alkyl group having 1 to 12 carbon atoms, an aryl group, a methoxy group, an ethoxy group, a hydrogen atom, a carboxyl group or a hydroxyl group; and $R_2$, $R_3$ and $R_4$ independently represent a halogen atom, a perfluoroalkyl group, a fluoro group, a nitro group, a carboxyl group and a hydrogen atom, and at least one of $R_2$, $R_3$ and $R_4$ is a one of the halogen atom, perfluoroalkyl group, fluoro group and nitro group;

(3)

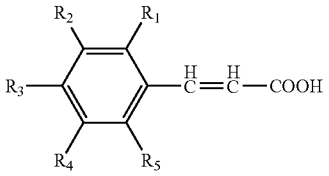

wherein $R_1$ and $R_5$ independently represent an alkyl group having 1 to 12 carbon atoms, an aryl group, a methoxy group, an ethoxy group, a hydrogen atom, a carboxyl group or a hydroxyl group; and $R_2$, $R_3$ and $R_4$ independently represent a halogen atom, a perfluoroalkyl group, a fluoro group, a nitro group, a carboxyl group and a hydrogen atom, and at least one of $R_2$, $R_3$ and $R_4$ is a one of the halogen atom, perfluoroalkyl group, fluoro group and nitro group;

(4)

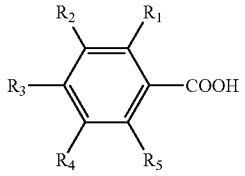

wherein $R_1$ and $R_5$ independently represent a halogen atom, a perfluoroalkyl group, a fluoro group, a nitro group, a carboxyl group and a hydrogen atom; and $R_2$, $R_3$ and $R_4$ independently represent an alkyl group having 1 to 12 carbon atoms, an aryl group, a methoxy group, an ethoxy group, a hydrogen atom, a carboxyl group or a hydroxyl group;

(5)

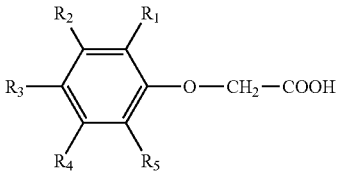

wherein $R_1$ and $R_5$ independently represent a halogen atom, a perfluoroalkyl group, a fluoro group, a nitro group, a carboxyl group and a hydrogen atom; and $R_2$, $R_3$ and $R_4$ independently represent an alkyl group having 1 to 12 carbon atoms, an aryl group, a methoxy group, an ethoxy group, a hydrogen atom, a carboxyl group or a hydroxyl group;

(6)

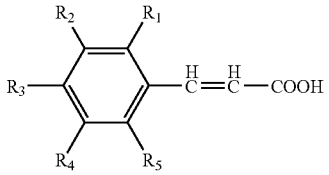

wherein $R_1$ and $R_5$ independently represent a halogen atom, a perfluoroalkyl group, a fluoro group, a nitro group, a carboxyl group and a hydrogen atom; and $R_2$, $R_3$ and $R_4$ independently represent an alkyl group having 1 to 12 carbon atoms, an aryl group, a methoxy group, an ethoxy group, a hydrogen atom, a carboxyl group or a hydroxyl group.

A compound having carboxyl groups such as a benzoic acid is known to form a dimer, wherein the carboxyl groups are connected one another by hydrogen bonding. Such a carboxylic acid derivative is dissolved in a solution to make the dimer a complete molecule, and connected again with the carboxyl group on the surface of the toner to be firmly fixed thereon. According to this method, a sublime compound and a heat-sensitive compound, which cannot be used in a conventional pulverized toner prepared by kneading a toner composition upon application of heat, can be used. This is because, similarly to a dimerized acetic acid having a high melting point, the carboxylic acid derivative connected to the surface of the toner formed of a polymer resin with two hydrogen bondings is more thermostable than being monomolecular or dimeric.

Thus, an organic molecule is selectively formed on a surface of a toner, the carboxylic acid is unexceptionally connected to the surface of the toner, and the carboxylic acid derivatives are arranged in the same direction to the surface thereof. The thus sophisticatedly arranged functional organic molecule is considered to have quite a high charge controllability.

The CCA needs to be included in the pulverized toner in an amount of at least not less than 0.5 parts by weight, and preferably more or less 1.0 parts by weight based on total weight of the toner to be present on the surface thereof in a specific amount and effectively work. Particularly, a colorless CCA for use in a color toner is included therein in an amount of not less than 2 parts by weight in many cases because of its low charge controlling effect. However, the functional organic molecule in the present invention is included in quite a small amount of 0.1 to 0.3 parts by weight, and has more charge controlling effect than the CCA used in the pulverized toner.

This is because the functional organic molecule is selectively present only on the surface of the toner, and at the same time, is sophisticatedly arranged thereon. An amount of charge can be determined by an amount of organic metallic compound formed thereon. The CCA is included therein in an amount of from 0.03 to 1.0% by weight, preferably from 0.05 to 0.5% by weight, and more preferably from 0.1 to 0.3% by weight. Compared with a conventional organic low-molecular-weight compound, the CCA selectively arranged on the surface thereof does not contaminate a charging member such as a carrier, and the resultant toner has a stable chargeability for long periods.

While surface-treated metal compounds noticeably increase a minimum fixable temperature of the resultant toner, the surface-treated organic compound does not at all.

FIG. 1 is a schematic view illustrating the tandem-type full-color image forming apparatus using an intermediate transfer and the toner of the present invention.

The tandem-type image forming apparatus includes an intermediate transfer belt 87, in which one photoreceptor is not shared by each color, and is equipped with photoreceptors 80Y, 80M, 80C and 80Bk for each color. In addition, the tandem-type image forming apparatus is also equipped with a photoreceptor cleaning unit 85 including the cleaner for use in the present invention, a discharging lamp 83 and a charging roller 84 uniformly charging the drum for each color. Numeral 81 is an imagewise light from an irradiator; 82 is an image developer; 86 is a bias roller; 88 is a resist roller; 89 is a paper (an image bearer); 90 is a paper transfer bias roller; 91 is a transfer belt; 92 is a transport belt; 93 is a fixing unit and 94 is a fur brush. The intermediate transferer prevents color drift and the toner of the present invention further improves the prevention, in addition to prevention of deterioration of image quality and increase of residual toner after transfer due to repeated transfers.

Figure 2:
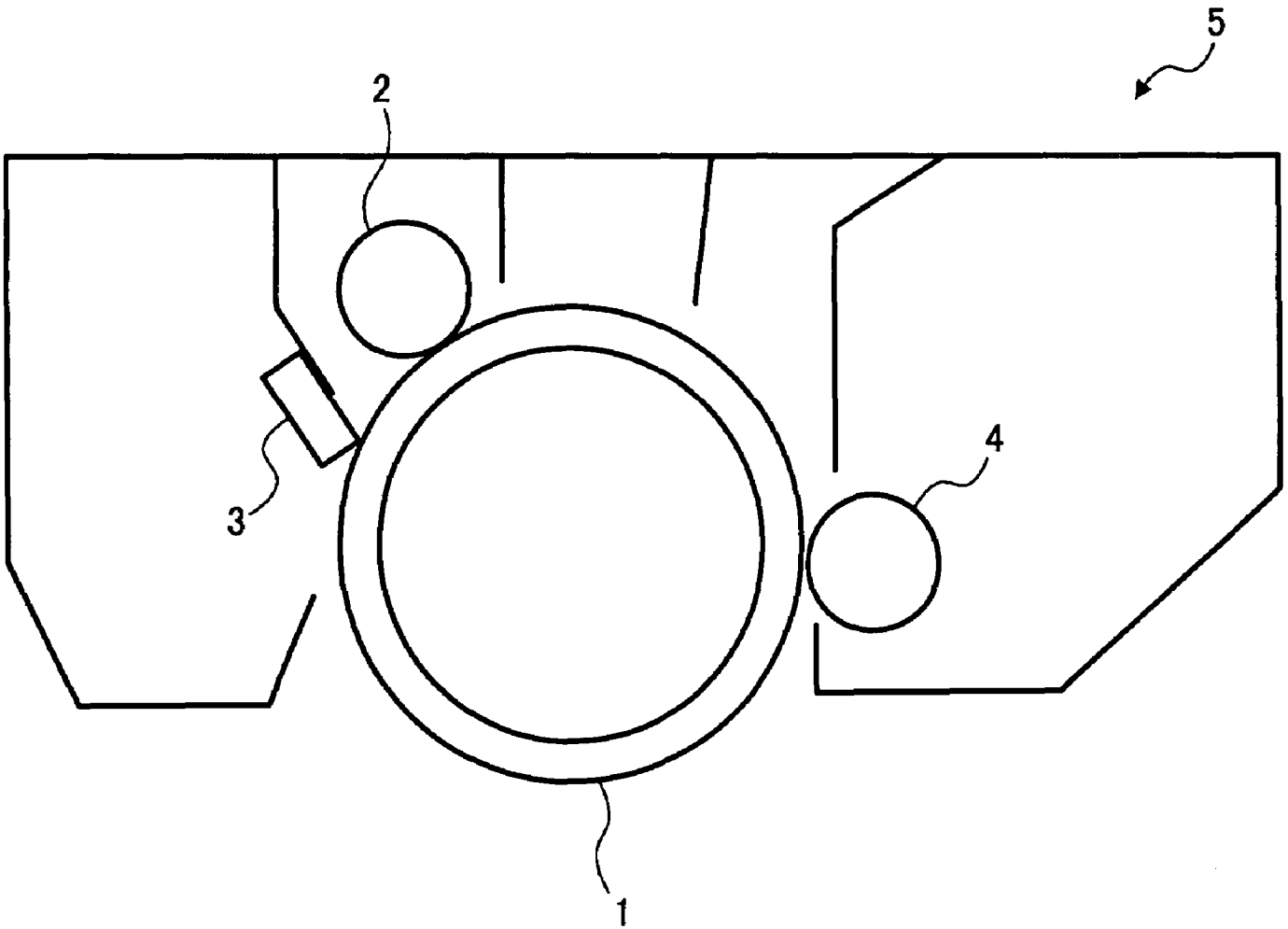
FIG. 2 is a schematic view illustrating an embodiment of the process cartridge of the present invention.

Further, the image forming apparatus can detachably be equipped with a process cartridge including an image developer, and at least one of a photoreceptor, a charger, an irradiator, a transferer, a cleaner and a discharger. FIG. 2 is a schematic view illustrating an embodiment of the process cartridge of the present invention, wherein numeral 1 is a photoreceptor, 2 is a charger, 3 is a cleaner, 4 is an image developer and 5 represents a whole process cartridge.

The toner of the present invention can be produced by the following method, but the method is not limited thereto.

Suspension Polymerization Method

In a mixture of an oil-soluble polymerization initiator and a polymerizing monomer, a colorant and a release agent are dispersed to prepare a dispersion, and the dispersion is subjected to a suspension dispersion in an aqueous medium including a surfactant and other solid dispersants. Then, an excess surfactant is preferably removed by washing to prepare a toner. Specific examples of the polymerizing monomer include acids such as styrene, an acrylic acid, a methacrylic acid, an α-cyanoacrylic acid, an α-cyanomethacrylic acid, an itaconic acid, a crotonic acid, a fumaric acid, a maleic acid and a maleic anhydride; acrylamide, methacrylamide, diacetoneacrylamide and their methylol compounds; vinylpyridine; vinylpyrrolidone; vinylimidazole; ethyleneimine; acrylate having an amino group such as dimethylamino methacrylate ethyl; methacrylate; etc.

Emulsion Polymerization Condensation Method

A mixture of a water-soluble polymerization initiator and a polymerizing monomer are emulsified in water using a surfactant to prepare a latex. Meanwhile, a colorant and a release agent are dispersed in an aqueous medium to prepare a dispersion. Then, the latex and dispersion are mixed, and the mixture is agglomerated to have a toner size and heated to be fused to prepare atoner. After that, the CCA of the present invention is included therein.

Polymer Suspension Method

The aqueous medium for use in the present invention may include water alone and mixtures of water with a solvent which can be mixed with water. Specific examples of the solvent include alcohols such as methanol, isopropanol and ethylene glycol; dimethylformamide; tetrahydrofuran; cellosolves such as methyl cellosolve; and lower ketones such as acetone and methyl ethyl ketone.

As an oil phase of a toner composition, a resin, a prepolymer, a colorant such as a pigment, a release agent and a CCA are dispersed in a volatile solvent. To decrease viscosity of the oil phase to be emulsified, a solvent capable of dissolving a polyester resin or a prepolymer is used. The solvent preferably has a volatility and a boiling point lower than 100° C. from the viewpoint of being easily removed from the dispersion after the particles are formed.

Specific examples of such a solvent include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, methyl isobutyl ketone, etc. These solvents can be used alone or in combination. Among these solvents, aromatic solvents such as toluene and xylene; and halogenated hydrocarbons such as methylene chloride, 1,2-dichloroethane, chloroform, and carbon tetrachloride are preferably used. Further, a combination with a solvent soluble with an aqueous medium such as alcohol and water can control a shape of the toner. The solvent is used in an amount of 10 to 900 parts by weight per 100 parts by weight of the toner composition.

Toner particles may be formed by reacting, e.g., a prepolymer having an isocyanate group, dispersing elements formed of other toner compositions in a volatile solvent and amines in an aqueous medium. To form the prepolymer and dispersing elements formed of toner compositions in the aqueous medium, a toner material formed of a prepolymer is added thereto, and dispersed by a shearing force. The prepolymer and other toner compositions (hereinafter referred to as toner constituents) such as colorants, master batch pigments, release agents, charge controlling agents, polyester resins, etc. may be added into an aqueous medium at the same time when the dispersion is prepared. However, it is preferable that the toner constituents are previously mixed and then the mixed toner constituents are added to the aqueous liquid at the same time.

Specific examples of the disperser include a conventional mixer, and preferably a homogenizer having a high-speed rotor and a stator, high-pressure homogenizer and dispersers using media such as a ball mill, a beads mill and a sand mill. In addition, in the present invention, colorants, release agents, charge controlling agents, etc., are not necessarily added to the aqueous dispersion before particles are formed, and may be added thereto after particles are prepared in the aqueous medium.

The dispersion method is not particularly limited, and low speed shearing methods, high-speed shearing methods, friction methods, high-pressure jet methods, ultrasonic methods, etc. can be used. Among these methods, high-speed shearing methods are preferably used because particles having a particle diameter of from 2 to 20 μm can be easily prepared.

An emulsifier having a rotating blade for use in the present invention is not particularly limited, and any marketed emulsifiers can be used. Specific examples of the emulsifiers include continuous emulsifiers such as ULTRA TALUX from IKA, POLYTRON from KINEMATICA AG, TKAUTO HOMOMIXER from TOKUSHU KIKA KOGYO CO., LTD., EBARA MILDER from Ebara Corp., TK PIPELINE HOMOMIXER and TK HOMOMIC LINE FLOW from TOKUSHU KIKA KOGYO CO., LTD., COLLOID MILL from Shinko Pantec Co., Ltd., SLASHER and TRIGONAL WET PULVERIZER from MITSUI MIIKE MACHINERY CO., LTD., CAVITRON from EURPTEC, LTD. and FINE FLOW MILL from Pacific Machinery & Engineering Co., Ltd.; and batch or continuous duplex emulsifiers such as CLEARMIX from MTECNIQUE Co., Ltd. and FILL MIX from TOKUSHU KIKA KOGYO CO., LTD.

When a high-speed shearing disperser is used, a rotation speed thereof is not particularly limited, but the rotation speed is typically from 1,000 to 30,000 rpm, and preferably from 5,000 to 20,000 rpm. The dispersion time is not also particularly limited, but is typically from 0.1 to 5 minutes. The temperature in the dispersion process is typically from 0 to 150° C. (under pressure), and preferably from 10 to 98° C. When the temperature is relatively high, the prepolymer can easily be dispersed because the dispersion formed thereof has a low viscosity.

A content of the aqueous medium to 100 parts by weight of the toner composition including the prepolymer is typically from 50 to 2,000 parts by weight, and preferably from 100 to 1,000 parts by weight. When the content is less than 50 parts by weight, the dispersion of the toner constituents in the aqueous medium is not satisfactory, and thereby the resultant mother toner particles do not have a desired particle diameter. In contrast, when the content is greater than 2,000, the production cost increases.

As an emulsion dispersion stabilizer, a solid particulate material may be dispersed in the aqueous medium as a dispersant besides the surfactant. Further, it is possible to stably disperse toner compositions in the aqueous medium using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine). In addition, polymers such as polyoxyalkylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When a dispersant is used, the dispersant may remain on a surface of the toner particle. However, the dispersant is preferably washed and removed after the elongation and/or crosslinking reaction of the prepolymer with amine in terms of better chargeability of the resultant toner.

The elongation and/or crosslinking reaction time depend on reactivity of the isocyanate structure of the prepolymer (A) and amine (B), but is typically from 10 min to 40 hrs, and preferably from 2 to 24 hrs. The reaction temperature is typically from 0 to 150° C., and preferably from 40 to 98° C. In addition, a known catalyst such as dibutyltinlaurate and dioctyltinlaurate can be used.

To remove an organic solvent from the emulsified dispersion, a method of gradually raising the temperature of the whole dispersion to completely remove the organic solvent in the droplet by vaporizing can be used. Otherwise, a method of spraying the emulsified dispersion in dry air, completely removing a water-insoluble organic solvent from the droplet to form toner particles and removing the water dispersant by vaporizing can also be used. As the dry air, atmospheric air, nitrogen gas, carbon dioxide gas, a gaseous body in which a combustion gas is heated, and particularly various aerial currents heated to have a temperature not less than a boiling point of the solvent used are typically used. A spray dryer, a belt dryer and a rotary kiln can sufficiently remove the organic solvent in a short time.

When the emulsified dispersion is washed and dried while maintaining a wide particle diameter distribution thereof, the dispersion can be classified to have a desired particle diameter distribution.

A cyclone, a decanter, a centrifugal separation, etc. can remove particles in a dispersion liquid. The powder remaining after the dispersion liquid is dried can be classified, but the liquid is preferably classified in terms of efficiency. Unnecessary fine and coarse particles can be recycled to a kneading process to form particles. The fine and coarse particles may be wet when recycled.

Dispersant is preferably removed from the dispersion liquid, and more preferably removed at the same time when the above-mentioned classification is performed.

Heterogeneous particles such as release agent particles, charge controlling particles, fluidizing particles and colorant particles can be mixed with the toner powder after drying. Release of the heterogeneous particles from composite particles can be prevented by giving a mechanical stress to a mixed powder to fix and fuse them on a surface of the composite particles.

Specific methods include a method of applying an impact force on the mixture with a blade rotating at high-speed, a method of putting a mixture in a high-speed stream and accelerating the mixture such that particles thereof collide with each other or composite particles thereof collide with a collision board, etc. Specific examples of the apparatus include an ONG MILL from Hosokawa Micron Corp., a modified I-type mill having a lower pulverizing air pressure from Nippon Pneumatic Mfg. Co., Ltd., a hybridization system from Nara Machinery Co., Ltd., a Kryptron System from Kawasaki Heavy Industries, Ltd., an automatic mortar, etc.

In any of the methods of preparing a toner of the present invention, the toner can be subjected to a surface-treatment having a charge controlling effect in a liquid. The surface-treatment is preferably performed after the toner particles are formed in the aqueous medium and the surfactant is removed by washing. The excess surfactant present therein is removed by a solid-liquid separating operation such as filtration and centrifugal separation to prepare a cake or a slurry, and the cake or slurry is dispersed again in an aqueous medium.

Then, an aqueous solution of a surfactant having a reverse polarity is gradually added to the aqueous medium wherein the cake or slurry is dispersed. A content of the surfactant having a reverse polarity is from 0.01 to 1% by weight based on total weight of a solid content of the toner particle.

A dispersion of a particulate CCA can be present in the slurry to control chargeability of the resultant toner. The CCA is powder under normal conditions, but the dispersion of the particulate CCA can be prepared by using the surfactant used to prepare a toner in an aqueous medium and the surfactant having a reverse polarity. The surfactant having a reverse polarity can neutralize a charge of the dispersion of a particulate CCA in the aqueous medium, and the CCA can be agglomerated and adhered onto a surface of the toner.

The particulate CCA in the dispersion preferably has a particle diameter of from 0.01 to 1 μm, and a content thereof is from 0.01 to 5% by weight based on total weight of a solid content of the toner particle.

To reinforce the chargeability of the resultant toner, a dispersion of a particulate resin can be present in the slurry. The dispersion of a particulate resin is preferably formed by emulsion polymerization.

The surfactant having a reverse polarity can neutralize a charge of the dispersion of a particulate resin in the aqueous medium, and the resin can be agglomerated and adhered onto a surface of the toner. A content of the particulate resin is from 0.01 to 5% by weight based on total weight of a solid content of the toner particle.

The particulate CCA and particulate resin adhered on the surface of the toner are then fixed thereon when the slurry is heated to prevent desorption thereof from the surface of the toner. Then, the slurry is preferably heated at a higher temperature than a glass transition temperature of a resin forming the toner. The toner may be heated after dried.

Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc. Specific examples of the marketed products of the charge controlling agents include BONTRON N-03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

Specific examples of the particulate charge controlling resin include polymer particulate materials, e.g., polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins can be used.

Specific examples of the surfactant include cationic surfactants such as amine salts including alkyl amine salts, aminoalcohol fatty acid derivatives, polyamine fatty acid derivatives and imidazoline; and quaternary ammonium salts including alkyltrimethyl ammonium salts, dialkyldimethyl ammonium salts, alkyldimethyl benzyl ammonium salts, pyridinium salts, alkyl isoquinolinium salts and benzethonium chloride.

Anionic surfactants include alkylbenzene sulfonic acid salts, α-olefin sulfonic acid salts and phosphoric acid salts.

Ampholytic surfactants such as fatty acid amide derivatives, polyhydric alcohol derivatives; and ampholytic surfactants such as alanine, dodecyldi(aminoethyl)glycin, di(octylaminoethyle)glycin, and N-alkyl-N,N-dimethylammonium betaine can also be used in combination with the cationic and anionic surfactants. The surfactant is preferably used in an amount of from 0.1 to 10% by weight based on total weight of the aqueous medium.

In the present invention, a surfactant having a fluoroalkyl group is preferably used as the surfactant having a reverse polarity to improve chargeability, particularly a charge speed of the resultant toner.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxyl}-1-alkyl(C3-C4)sulfonate, sodium-{omega-fluoroalkanoyl(C6-C8)-N-ethylamino}-1-propane sulfonate, fluoroalkyl(C11-C20)carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, monoperfluoroalkyl(C6-C16)ethylphosphates, etc.

Specific examples of the marketed products of such surfactants having a fluoroalkyl group include SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOP EF-102, 103, 104, 105, 112, 123A, 306A, 501, 201 and 204, which are manufactured by Tohchem Products Co., Ltd.; FUTARGENT F-100 and F150 manufactured by Neos; etc.

Particularly, chargeability of the resultant developer is less affected by an environmental variation and stable when the surfactants include a fluorine-containing surfactant or a quaternary ammonium cationic surfactant having the following formulae (7) and (8) respectively:

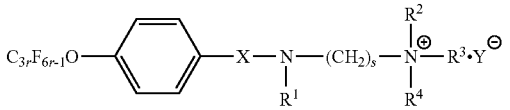

(7)

wherein X represents —$SO_2$ or —CO—; $R^1$, $R^2$, $R^3$ and $R^4$ independently represent a hydrogen atom, a lower alkyl group having 1 to 10 carbon atoms or an aryl group; Y represents I or Br; and r and s independently represent an integer of from 1 to 20, or

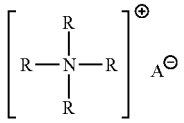

(8)

wherein R independently represents an alkyl group having 3 to 20 carbon atoms or a hydrogen atom, but at least one R is an alkyl group having 3 to 20 carbon atoms; and A represents an anion such as a chlorine atom.

A solid particulate dispersant is preferably an inorganic particulate material having an average particle diameter of from 0.01 to 1 μm, which is difficult to dissolve in water and is solid in the aqueous medium.

Specific examples of the inorganic particulate material include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Further, tricalcium phosphate, calcium carbonate, colloidal titanium oxide, colloidal silica and hydroxyapatite are preferably used. Particularly, hydroxyapatite which is a basic reaction product between sodium phosphate and calcium chloride is more preferably used. Besides, organic solid particulate dispersant includes a microcrystal of a low-molecular-weight compound and a polymer particulate material, e.g., polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins.

The polyester prepolymer including an isocyanate group (A) is formed from a reaction between polyester having an active hydrogen atom formed by polycondensation between a polyol (1) and a polycarboxylic acid (2), and polyisocyanate (3). Specific examples of the groups including the active hydrogen include a hydroxyl group (such as an alcoholic hydroxyl group and a phenolic hydroxyl group), an amino group, a carboxyl group, a mercapto group, etc. In particular, the alcoholic hydroxyl group is preferably used.

As the polyol (1), diol (1-1) and polyols having 3 valences or more (1-2) can be used, and (1-1) alone or a mixture of (1-1) and a small amount of (1-2) are preferably used. Specific examples of diol (1-1) include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol and polytetramethylene ether glycol; alicyclic diols such as 1,4-cyclohexanedimethanol and hydrogenated bisphenol A; bisphenol such as bisphenol A, bisphenol F and bisphenol S; adducts of the above-mentioned alicyclic diol with an alkylene oxide such as ethylene oxide, propylene oxide and butylene oxide; and adducts of the above-mentioned bisphenol with an alkylene oxide such as ethylene oxide, propylene oxide and butylene oxide. In particular, an alkylene glycol having 2 to 12 carbon atoms and adducts of bisphenol with an alkylene oxide are preferably used, and a mixture thereof is more preferably used. Specific examples of the polyol having 3 valences or more (1-2) include multivalent aliphatic alcohols having 3 to 8 or more valences such as glycerin, trimethylolethane, trimethylolpropane, pentaerythritol and sorbitol; phenols having 3 or more valences such as trisphenol PA, phenolnovolak, cresolnovolak; and adducts of the above-mentioned polyphenol having 3 or more valences with an alkylene oxide.

As the polycarboxylic acid (2), dicarboxylic acids (2-1) and polycarboxylic acids having 3 or more valences (2-2) can be used. (2-1) alone, or a mixture of (2-1) and a small amount of (2-2) are preferably used. Specific examples of the dicarboxylic acid (2-1) include alkylene dicarboxylic acids such as succinic acid, adipic acid and sebacic acid; alkenylene dicarboxylic acids such as maleic acid and fumaric acid; and aromatic dicarboxylic acids such as phthalic acid, isophthalic acid, terephthalic acid and naphthalene dicarboxylic acid.

In particular, an alkenylene dicarboxylic acid having 4 to 20 carbon atoms and an aromatic dicarboxylic acid having 8 to 20 carbon atoms are preferably used. Specific examples of the polycarboxylic acid having 3 or more valences (2-2) include aromatic polycarboxylic acids having 9 to 20 carbon atoms such as trimellitic acid and pyromellitic acid. The polycarboxylic acid (2) can be formed from a reaction between one or more of the polyols (1) and an anhydride or lower alkyl ester of one or more of the above-mentioned acids. Suitable preferred lower alkyl esters include, but are not limited to, methyl esters, ethyl esters and isopropyl esters.

The polyol (1) and polycarboxylic acid (2) are mixed such that the equivalent ratio ([OH]/[COOH]) between a hydroxyl group [OH] and a carboxyl group [COOH] is typically from 2/1 to 1/1, preferably from 1.5/1 to 1/1, and more preferably from 1.3/1 to 1.02/1.

Specific examples of the polyisocyanate (3) include aliphatic polyisocyanates such as tetramethylenediisocyanate, hexamethylenediisocyanate and 2,6-diisocyanatemethylcaproate; alicyclic polyisocyanates such as isophorondiisocyanate and cyclohexylmethanediisocyanate; aromatic diisocyanates such as tolylenedisocyanate and diphenylmethanediisocyanate; aromatic aliphatic diisocyanates such as α, α, α', α'-tetramethylxylylenediisocyanate; isocyanurates; the above-mentioned polyisocyanates blocked with phenol derivatives, oxime and caprolactam; and their combinations.

The polyisocyanate (3) is mixed with polyester such that an equivalent ratio ([NCO]/[OH]) between an isocyanate group [NCO] and polyester having a hydroxyl group [OH] is typically from 5/1 to 1/1, preferably from 4/1 to 1.2/1 and more preferably from 2.5/1 to 1.5/1. When [NCO]/[OH] is greater than 5, low-temperature fixability of the resultant toner deteriorates. When [NCO] has a molar ratio less than 1, a urea content in ester of the modified polyester decreases and hot offset resistance of the resultant toner deteriorates. A content of the constitutional component of a polyisocyanate in the polyester prepolymer (A) having a polyisocyanate group at its end is from 0.5 to 40% by weight, preferably from 1 to 30% by weight and more preferably from 2 to 20% by weight. When the content is less than 0.5% by weight, hot offset resistance of the resultant toner deteriorates, and in addition, the heat resistance and low-temperature fixability of the toner also deteriorate. In contrast, when the content is greater than 40% by weight, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of isocyanate groups is less than 1 per molecule, the molecular weight of the modified polyester (i) decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amino groups in the amines (B1) to (B5) are blocked. Specific examples of the diamines (B1) include aromatic diamines such as phenylene diamine, diethyltoluene diamine and 4,4'-diaminodiphenyl methane; alicyclic diamines such as 4,4'-diamino-3,3'-dimethyldicyclohexyl methane, diaminocyclohexane and isophorondiamine; aliphatic diamines such as ethylene diamine, tetramethylene diamine and hexamethylene diamine, etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines (B1) to (B5) with a ketone such as acetone, methyl ethyl ketone and methyl isobutyl ketone; oxazoline compounds, etc. Among these amines (B), diamines (B1) and mixtures in which a diamine is mixed with a small amount of a polyamine (B2) are preferably used.

A molecular weight of the modified polyester (i) can optionally be controlled using an elongation anticatalyst, if desired. Specific examples of the elongation anticatalyst include monoamines such as diethyl amine, dibutyl amine, butyl amine and lauryl amine, and blocked amines, i.e., ketimine compounds prepared by blocking the monoamines mentioned above.

A mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, the molecular weight of the modified polyester (i) decreases, resulting in deterioration of hot offset resistance of the resultant toner. The modified polyester (i) may include a urethane bonding as well as a urea bonding. A molar ratio (urea/urethane) of the urea bonding to the urethane bonding is from 100/0 to 10/90, preferably from 80/20 to 20/80 and more preferably from 60/40 to 30/70. When the content of the urea bonding is less than 10%, hot offset resistance of the resultant toner deteriorates.

In the present invention, an unmodified polyester (C) can be used in combination with the modified polyester (i), prepolymer (A) and amines (B) as a toner binder resin. It is more preferable to use the unmodified polyester (C) in combination with the modified polyester (i) than to use the modified polyester (i) alone because low-temperature fixability and glossiness of full color images of the resultant toner improve. Specific examples of the unmodified polyester resin (C) include polycondensed products between the polyol (1) and polycarboxylic acid (2) similarly to the modified polyester (i), and the components preferably used are the same as those thereof.

The unmodified polyester resin (C) may be modified by other chemical bondings besides the urea-bonding, such as urethane-bonding. It is preferable that a reaction products between the prepolymer (A) and amines (B), and the unmodified polyester resin (C) are partially soluble with each other in terms of the low-temperature fixability and hot offset resistance of the resultant toner. Therefore, the polyester resin of the prepolymer (A) and unmodified polyester resin (C) preferably have similar compositions. When the unmodified polyester resin (C) is used in combination, a weight ratio ((A)/(C)) between the polyester resin of the prepolymer (A) and unmodified polyester resin (C) is from 5/95 to 80/20, preferably from 5/95 to 30/70, more preferably from 5/95 to 25/75, and most preferably from 7/93 to 20/80. When the polyester resin of the prepolymer (A) has a weight ratio less than 5%, the resultant toner has poor hot offset resistance, and has difficulty in having a thermostable preservability and low-temperature fixability.

The unmodified polyester resin (C) preferably has a peak molecular weight of from 1,000 to 30,000, preferably from 1,500 to 10,000, and more preferably from 2,000 to 8,000. When less than 1,000, the thermostable preservability of the resultant toner deteriorates. When greater than 10,000, the low-temperature fixability thereof deteriorates. The unmodified polyester resin (C) preferably has a hydroxyl value not less than 5 mg KOH/g, more preferably of from 10 to 120 mg KOH/g, and most preferably from 20 to 80 mg KOH/g. When less than 5, the resultant toner has difficulty in having thermostable preservability and low-temperature fixability. The unmodified polyester resin (C) preferably has an acid value of from 1 to 30 mg KOH/g, and more preferably from 5 to 20 mg KOH/g such that the resultant toner tends to be negatively charged and to have better fixability.

In the present invention, the toner binder resin preferably has a glass transition temperature (Tg) of from 50 to 70° C., and more preferably from 55 to 65° C. When less than 50° C., the thermostable preservability of the resultant toner deteriorates. When greater than 70° C., the low-temperature fixability thereof is insufficient. In the present invention, the toner binder resin preferably has a temperature at which a storage modulus of the toner binder resin is 10,000 dyne/cm$^2$ at a measuring frequency of 20 Hz (TG'), of not less than 100° C., and more preferably of from 110 to 200° C. When less than 100° C., the hot offset resistance of the resultant toner deteriorates.

The toner binder resin preferably has a temperature at which the viscosity is 1,000 poise (Tη), of not greater than 180° C., and more preferably of from 90 to 160° C. When greater than 180° C. the low-temperature fixability of the resultant toner deteriorates. Namely, TG' is preferably higher than Tη in terms of the low-temperature fixability and hot offset resistance of the resultant toner. In other words, the difference between TG' and Tη (TG'−Tη) is preferably not less than 0° C., more preferably not less than 10° C., and furthermore preferably not less than 20° C. The maximum of the difference is not particularly limited. In terms of the thermostable preservability and low-temperature fixability of the resultant toner, the difference between TG' and Tη (TG'−Tη) is preferably from 0 to 100° C., more preferably from 10 to 90° C., and most preferably from 20 to 80° C.

Specific examples of the colorants for use in the present invention include any known dyes and pigments such as carbon black, Nigrosine dyes, black ironoxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight, based on total weight of the toner.

The colorant for use in the present invention can be used as a master batch pigment, if desired, when combined with a resin.

Specific examples of the resin for use in the master batch pigment or for use in combination with master batch pigment include the modified and unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butylmethacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batch for use in the toner of the present invention is typically prepared by mixing and kneading a resin and a colorant upon application of high shear stress thereto. In this case, an organic solvent can be used to heighten the interaction of the colorant with the resin. In addition, flushing methods in which an aqueous paste including a colorant is mixed with a resin solution of an organic solvent to transfer the colorant to the resin solution and then the aqueous liquid and organic solvent are separated and removed, can be preferably used because the resultant wet cake of the colorant can be used as it is. Of course, a dry powder which is prepared by drying the wet cake can also be used as a colorant. In this case, a three roll mill is preferably used for kneading the mixture upon application of high shearing stress.

The toner of the present invention may include a wax together with a binder resin and a colorant. Specific examples of the wax include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used.

Specific examples thereof include polyesteralkanates such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanates such as ethylenediaminebehenylamide; polyalkylamides such as tristearylamidetrimellitate; and dialkylketones such as distearylketone.

Among these waxes including a carbonyl group, a polyesteralkanate is preferably used. The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature. In addition, the wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner. The content of the wax in a toner is preferably from 0 to 40% by weight, and more preferably from 3 to 30% by weight.

A dry toner can be produced by the following method, but the method is not limited thereto.

To improve the fluidity, preservability, developability and transferability of a developer, inorganic fine particles, such as a hydrophobic silica fine powder as mentioned above, are externally added thereto. A conventional powder mixer can be used to mix the external additive, and the mixer preferably has a jacket and can control an inner temperature thereof. To change a history of a load to the external additive, the external additive may be added to the toner completely prior to mixing or gradually added there to during mixing. As a matter of course, the number of revolutions, rolling speed, time and temperature of the mixer may be changed. A large load first and next a small load, or vice versa may be applied to the toner.

Specific examples of the mixer include a V-form mixer, a locking mixer, a Loedge Mixer, a Nauter Mixer, a Henshel Mixer, etc.

To further control a shape of the toner, a method of mechanically ensphering the toner by using a hybridizer or a Mechanofusion after the pulverizing process, a method which is so-called a spray dry method of ensphering the toner by using a spray dryer to remove a solvent after toner materials are dissolved and dispersed in the solvent capable of dissolving a toner binder, and a method of ensphering the toner by heating the toner in an aqueous medium can be used. However, the methods are not limited thereto.

As an external additive to subsidize the fluidity, developability and chargeability of a colored particle prepared in the present invention, inorganic particulate material can be used. The inorganic particulate material preferably has an average primary particle diameter of from 5 nm to 2 μm, and more preferably from 5 to 500 nm. Further, the external additive preferably has a specific surface area of from 20 to 500 $m^2/g$ when measured by a BET method. A content thereof is preferably from 0.01 to 5% by weight, and more preferably from 0.01 to 2% by weight per 100% by weight of the toner.

Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, rediron oxide, antimony trioxide, magnesium oxide, zirconium oxide, barium sulfate, barium carbonate, calcium carbonate, silicon carbide, silicon nitride, etc.

Besides, polymer particulate materials, e.g., polystyrene, ester methacrylate and ester acrylate copolymers formed by soap-free emulsifying polymerization, suspension polymerization and dispersion polymerization; polycondensated particulate materials such as silicone, benzoguanamine and nylon; and polymerized particulate materials formed of thermosetting resins can be used.

Such fluidizers can be surface-treated with a surface treatment agent to increase the hydrophobicity to prevent deterioration of fluidity and chargeability even in an environment of high humidity. Specific examples of the surface treatment agent include a silane coupling agent, a sililating agents a silane coupling agent having an alkyl fluoride group, an organic titanate coupling agent, an aluminium coupling agent a silicone oil and a modified silicone oil.

The toner of the present invention may include a cleanability improver for removing a developer remaining on a photoreceptor and a first transfer medium after transferred. Specific examples of the cleanability improver include fatty acid metallic salts such as zinc stearate, calcium stearate and stearic acid; and polymer particles prepared by a soap-free emulsifying polymerization method such as polymethylmethacrylate particles and polystyrene particles. The polymer particles comparatively have a narrow particle diameter distribution and preferably have a volume-average particle diameter of from 0.01 to 1 μm.

The toner of the present invention can be used for a two-component developer in which the toner is mixed with a magnetic carrier. A content of the toner is preferably from 1 to 10 parts by weight per 100 parts by weight of the carrier. Suitable carriers for use in the two component developer include known carrier materials such as iron powders, ferrite powders, magnetite powders, magnetic resin carriers, which have a particle diameter of from about 20 to about 200 μm. The carrier may be coated by a resin. Specific examples of such resins to be coated on the carriers include amino resins such as urea-formaldehyde resins, melamine resins, benzoguanamine resins, urea resins, and polyamide resins, and epoxy resins.

In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

An electroconductive powder may optionally be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic or non-magnetic developer without a carrier.

The developer of the present invention can be used in an image forming method wherein plural image developers equipped with a developing blade uniformly regulating a layer thickness of the developer fed on a developing roller develop an electrostatic latent image of each color formed on a single photoreceptor with a developer having the each color. In addition, the developer of the present invention can be used in an image forming method wherein plural image developers equipped with a developing blade uniformly regulating a layer thickness of the developer fed on a developing roller develop an electrostatic latent image of each color formed on a single photoreceptor with a developer having the each color to form a toner image, and the toner image is transferred onto an intermediate transferer by the electric field.

Further, the developer of the present invention can be used in an image forming method wherein plural image developers equipped with a developing blade uniformly regulating a layer thickness of the developer fed on a developing roller develop an electrostatic latent image of each color formed on plural photoreceptors with a developer having the each color.

Furthermore, the developer of the present invention can be used in an image forming method wherein plural image developers equipped with a developing blade uniformly regulating a layer thickness of the developer fed on a developing roller develop an electrostatic latent image of each color formed on plural photoreceptors with a developer having the each color to form a toner image, and the toner image is transferred onto an intermediate transferer by the electric field.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Polyester Resin 724 parts of an adduct of bisphenol A with 2 moles of ethyleneoxide, 276 parts isophthalic acid and 2 parts of dibutyltinoxide are mixed and reacted in a reactor vessel including a cooling pipe, a stirrer and a nitrogen inlet pipe for 8 hrs at normal pressure and 230° C. Further, after the mixture is depressurized to 10 to 15 mm Hg (absolute) and reacted for 5 hrs to prepare an unmodified polyester resin having a peak molecular weight of 4,800. 100 parts of the unmodified polyester resin is dissolved and mixed in 100 parts of ethyl acetate to prepare an ethyl acetate solution of the toner binder resin. The ethyl acetate solution of the toner binder resin is partially depressurized and dried to isolate the polyester resin. The polyester resin has a glass transition temperature (Tg) of 58° C. and an acid value of 8.

Example 1

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, the toner composition is included in the beaker, and stirred and emulsified for 3 min while an inner temperature of the beaker is maintained at 20° C. and a mixture therein is stirred by the T.K. HOMO MIXER from Tokushu Kika Kogyo Co., Ltd. at 12,000 rpm.

The mixture is included in a flask having a stirrer and a thermometer, and wherein the mixture is depressurized to 10 to 15 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake. The cake is further dispersed in distilled water so as to have a solid content of 10% by weight to prepare a dispersion.

An aqueous solution of 4-trifluoromethyl sodium benzoate having a concentration of 1% is included in the dispersion such that a purity content of the 4-trifluoromethyl benzoate is 0.3% by weight per 100% by weight of the solid content of the toner and stirred for 15 min to prepare a slurry, while a temperature of the dispersion is maintained at 20° C. and stirred. Further, an aqueous solution of a phosphoric acid having a normal concentration is included in the dispersion at 0.3 ml/min to prepare a slurry having a pH of 4 while a temperature of the dispersion is maintained, and stirred for 1 hr. Then, the slurry is filtered to prepare a cake and the cake is subjected to a reduced-pressure drying at 40° C. for 24 hrs to prepare a toner particle. 0.5 parts of hydrophobic silica and 0.5 parts of hydrophobized titanium oxide are mixed with 100 parts of the toner particle by a HENSCHEL MIXER to prepare the toner of the present invention.

Synthesis of Polyester Including Isocyanate 724 parts of an adduct of bisphenol A with 2 moles of ethyleneoxide, 276 parts isophthalic acid and 2 parts of dibutyltinoxide are mixed and reacted in a reactor vessel including a cooling pipe, a stirrer and a nitrogen inlet pipe for 8 hrs at a normal pressure and 230° C. Further, after the mixture is depressurized to 10 to 15 mm Hg and reacted for 5 hrs, the mixture is cooled to have a temperature of 160° C. and 32 parts of phthalic anhydride is added thereto. Then, the mixture is cooled to have a temperature of 80° C., 188 parts of isophoronediisocyanate are added thereto in ethyl acetate and the mixture is reacted for 2 hrs to prepare a prepolymer including isocyanate.

Synthesis of Ketimine Compound 170 parts of isophorondiamine and 75 parts of methyl ethyl ketone were reacted at 50° C. for 4 hrs in a reaction vessel including a stirrer and a thermometer to prepare a ketimine compound. The ketimine compound had an amine value of 418.

Example 2

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, 1 part of an oil phase including the ketimine compound just before emulsified is included in the toner composition while an inner temperature of the beaker is maintained at 20° C. and a mixture therein is stirred by the T.K. HOMO MIXER from Tokushu Kika Kogyo Co., Ltd. at 12,000 rpm for 3 min to be emulsified.

The mixture is included in a flask having a stirrer and a thermometer, and wherein the mixture is depressurized to 50 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake. The cake is further dispersed in distilled water so as to have a solid content of 10% by weight to prepare a dispersion.

An aqueous solution of 4-trifluoromethyl sodium benzoate having a concentration of 1% is included in the dispersion such that a purity content of the 4-trifluoromethyl benzoate is 0.3% by weight per 100% by weight of the solid content of the toner and stirred for 15 min to prepare a slurry, while a temperature of the dispersion is maintained at 20° C. and stirred. Further, an aqueous solution of a phosphoric acid having a normal concentration is included slowly in the dispersion to prepare a slurry having a pH of 4 while a temperature of the dispersion is maintained, and the slurry is stirred for 1 hr. Then, the slurry is filtered to prepare a cake and the cake is subjected to a reduced-pressure drying at 40° C. for 24 hrs to prepare a toner particle after stirred for 1 hr at room temperature. 0.5 parts of hydrophobic silica and 0.5 parts of hydrophobized titanium oxide are mixed with 100 parts of the toner particle by a HENSCHEL MIXER to prepare the toner of the present invention.

Example 3

The procedure for preparation of the toner in Example 1 is repeated to prepare the toner of the present invention except for changing the purity content of the 4-trifluoromethyl benzoate from 0.3 to 0.1% by weight per 100% by weight of the solid content of the toner.

Example 4

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, the toner composition is included in the beaker, and stirred and emulsified for 3 min while an inner temperature of the beaker is maintained at 20° C. and a mixture therein is stirred by the T.K. HOMO MIXER from Tokushu Kika Kogyo Co., Ltd. at 12,000 rpm.

The mixture is included in a flask having a stirrer and a thermometer, and wherein the mixture is depressurized to 50 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake. The cake is further dispersed in distilled water so as to have a solid content of 10% by weight to prepare a dispersion.

An aqueous solution of 4-trifluoromethyl sodium benzoate having a concentration of 1% is included in the dispersion such that a purity content of the 4-trifluoromethyl benzoate is 0.3% by weight per 100% by weight of the solid content of the toner and stirred for 15 min to prepare a slurry, while a temperature of the dispersion is maintained at 20° C. and stirred. Further, an aqueous solution of a phosphoric acid having a normal concentration is included slowly in the dispersion to prepare a slurry having a pH of 4 while a temperature of the dispersion is maintained, and the slurry is stirred for 1 hr.

Further, 0.05% by weight of an aqueous solution including a quaternary ammonium salt charge controlling agent, TP-415 from HODOGAYA CHEMICAL CO., LTD., of 1% by weight is added to the slurry per 100% by weight of the solid content of the toner. Then, the slurry is filtered to prepare a cake and the cake is subjected to a reduced-pressure drying at 40° C. for 24 hrs to prepare a toner particle after stirred for 1 hr at room temperature. 0.5 parts of hydrophobic silica and 0.5 parts of hydrophobized titanium oxide are mixed with 100 parts of the toner particle by a HENSCHEL MIXER to prepare the toner of the present invention.

Preparation of a Charge Controlling Agent Dispersion 1

10 parts of Nigrosine dye charge controlling agent BONTRON N-04 from Orient Chemical Industries, LTD., 100 parts of distilled water and 1 part of sodium dodecylbenzenesulfonate are dispersed in a closed pot by a ball mill using zirconia beads having a diameter of 5 mm for 24 hrs to prepare a charge controlling agent dispersion 1. The Nigrosine dye charge controlling agent is all dispersed to have a particle diameter not greater than 1 μm.

Example 5

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, 1 part of an oil phase including the ketimine compound just before emulsified is included in the toner composition while an inner temperature of the beaker is maintained at 20° C. and a mixture therein is stirred by the T.K. HOMO MIXER from Tokushu Kika Kogyo Co., Ltd. at 12,000 rpm for 3 min to be emulsified.

The mixture is included in a flask having a stirrer and a thermometer, and wherein the mixture is depressurized to 50 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake. The cake is further dispersed in distilled water so as to have a solid content of 10% by weight to prepare a dispersion.

An aqueous solution of 4-trifluoromethyl sodium benzoate having a concentration of 1% is included in the dispersion such that a purity content of the 4-trifluoromethyl benzoate is 0.03% by weight per 100% by weight of the solid content of the toner and stirred for 15 min to prepare a slurry, while a temperature of the dispersion is maintained at 20° C. and stirred. Further, an aqueous solution of a phosphoric acid having a normal concentration is included slowly in the dispersion to prepare a slurry having a pH of 4 while a temperature of the dispersion is maintained, and the slurry is stirred for 1 hr.

Further, the charge controlling agent dispersion 1 is added to the slurry while stirred such that the Nigrosine dye charge controlling agent has a purity content of 0.3% by weight per 100% by weight of the solid content of the toner. Then, the slurry is filtered to prepare a cake and the cake is subjected to a reduced-pressure drying at 40° C. for 24 hrs to prepare a toner particle after stirred for 1 hr at 20° C. 0.5 parts of hydrophobic silica and 0.5 parts of hydrophobized titanium oxide are mixed with 100 parts of the toner particle by a HENSCHEL MIXER to prepare the toner of the present invention.

Example 6

The procedure for preparation of the toner in Example 1 is repeated to prepare the toner of the present invention except for changing the 4-trifluoromethyl benzoate to 4-trifluoromethyl cinnamate.

Example 7

The procedure for preparation of the toner in Example 1 is repeated to prepare the toner of the present invention except for changing the 4-trifluoromethyl benzoate to 4-trifluoromethyl phenoxy acetate.

Example 8

The procedure for preparation of the toner in Example 1 is repeated to prepare the toner of the present invention except for changing the 4-trifluoromethyl benzoate to 2-methoxy benzoate.

Synthesis of Particulate Resin 683 parts of water, 11 parts of a sodium salt of an adduct of a sulfuric ester with ethyleneoxide methacrylate (ELEMINOL RS-30 from Sanyo Chemical Industries, Ltd.), 138 parts of styrene, 83 parts of methacrylate, 55 parts of tetrafluoroethyl methacrylate and a 1 part of persulfate ammonium are mixed in a reactor vessel including a stirrer and a thermometer, and the mixture is stirred for 15 min at 400 rpm to prepare a white emulsion therein. The white emulsion is heated to have a temperature of 75° C. and reacted for 5 hrs. Further, 30 parts of an aqueous solution of persulfate ammonium having a concentration of 1% are added thereto and the mixture is reacted for 5 hrs at 75° C. to prepare an aqueous dispersion a of a vinyl resin (a copolymer of a sodium salt of an adduct of styrene-methacrylate-tetrafluoroethyl methacrylate-sulfuric ester with ethyleneoxide methacrylate). The particulate resin dispersion liquid is measured by LA-920 from Horiba, Ltd. to find a volume-average particle diameter thereof was 0.25 μm.

Example 9

The procedure for preparation of the toner in Example 5 is repeated to prepare the toner of the present invention except for changing the charge controlling agent dispersion 1 to the particulate resin dispersion liquid to have a solid content of 1.0% by weight per 100% by weight of the solid content of the toner.

Comparative Example 1

The procedure for preparation of the toner in Example 1 is repeated to prepare a comparative toner except for changing the 4-trifluoromethyl benzoate to distilled water.

Comparative Example 2

The procedure for preparation of the toner in Example 1 is repeated to prepare a comparative toner except that the pH of the slurry is not controlled after the carboxylic acid derivative is included therein and is 8.

Then, the slurry is filtered to prepare a filtered liquid, and a pH thereof is reduced to 2 with a hydrochloric acid to find that an amount of the carboxylic acid separated out is almost same as that of the carboxylic acid included in the slurry. The carboxylic acid is scarcely reacted.

Comparative Example 3

The procedure for preparation of the toner in Example 1 is repeated to prepare a comparative toner except that the aqueous solution of a phosphoric acid is all at once included in the dispersion.

Then, the resultant slurry is filtered to prepare a filtered liquid, and a pH thereof is reduced to 2 with a hydrochloric acid to find that an amount of the carboxylic acid separated out is almost same as that of the carboxylic acid included in the slurry. The carboxylic acid is scarcely reacted.

Example 10

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, the toner composition is included in the beaker, and stirred and emulsified for 3 min while an inner temperature of the beaker is maintained at 20° C. and a mixture therein is stirred by the T.K. HOMO MIXER from Tokushu Kika Kogyo Co., Ltd. at 12,000 rpm.

The mixture is included in a flask having a stirrer and a thermometer, and wherein the mixture is depressurized to 10 to 15 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake. The cake is further dispersed in distilled water so as to have a solid content of 10% by weight to prepare a dispersion.

An aqueous solution of 4-methyl sodium cinnamate having a concentration of 1% is included in the dispersion such that a purity content of the 4-methyl cinnamate is 0.3% by weight per 100% by weight of the solid content of the toner and stirred for 15 min to prepare a slurry, while a temperature of the dispersion is maintained at 20° C. and stirred. Further, an aqueous solution of a phosphoric acid having a normal concentration is included in the dispersion at 0.3 ml/min to prepare a slurry having a pH of 4 while a temperature of the dispersion is maintained, and stirred for 1 hr. Then, the slurry is filtered to prepare a cake and the cake is subjected to a reduced-pressure drying at 40° C. for 24 hrs to prepare a toner particle. 0.5 parts of hydrophobic silica and 0.5 parts of hydrophobized titanium oxide are mixed with 100 parts of the toner particle by a HENSCHEL MIXER to prepare the toner of the present invention.

Synthesis of Polyester Including Isocyanate 724 parts of an adduct of bisphenol A with 2 moles of ethyleneoxide, 276 parts isophthalic acid and 2 parts of dibutyltinoxide are mixed and reacted in a reactor vessel including a cooling pipe, a stirrer and a nitrogen inlet pipe for 8 hrs at a normal pressure and 230° C. Further, after the mixture is depressurized to 10 to 15 mm Hg and reacted for 5 hrs, the mixture is cooled to have a temperature of 160° C. and 32 parts of phthalic anhydride is added thereto. Then, the mixture is cooled to have a temperature of 80° C., 188 parts of isophoronediisocyanate are added thereto in ethyl acetate and the mixture is reacted for 2 hrs to prepare a prepolymer including isocyanate.

Synthesis of Ketimine Compound 170 parts of isophorondiamine and 75 parts of methyl ethyl ketone were reacted at 50° C. for 4 hrs in a reaction vessel including a stirrer and a thermometer to prepare a ketimine compound. The ketimine compound had an amine value of 418.

Example 11

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, 1 part of an oil phase including the ketimine compound just before emulsified is included in the toner composition while an inner temperature of the beaker is maintained at 20° C. and a mixture therein is stirred by the T.K. HOMO MIXER from Tokushu Kika Kogyo Co., Ltd. at 12,000 rpm for 3 min to be emulsified.

The mixture is included in a flask having a stirrer and a thermometer, and wherein the mixture is depressurized to 50 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake. The cake is further dispersed in distilled water so as to have a solid content of 10% by weight to prepare a dispersion.

An aqueous solution of 4-methyl sodium cinnamate having a concentration of 1% is included in the dispersion such that a purity content of the 4-methyl cinnamate is 0.3% by weight per 100% by weight of the solid content of the toner and stirred for 15 min to prepare a slurry, while a temperature of the dispersion is maintained at 20° C. and stirred. Further, an aqueous solution of a phosphoric acid having a normal concentration is included slowly in the dispersion to prepare a slurry having a pH of 4 while a temperature of the dispersion is maintained, and the slurry is stirred for 1 hr. Then, the slurry is filtered to prepare a cake and the cake is subjected to a reduced-pressure drying at 40° C. for 24 hrs to prepare a toner particle after stirred for 1 hr at room temperature. 0.5 parts of hydrophobic silica and 0.5 parts of hydrophobized titanium oxide are mixed with 100 parts of the toner particle by a HENSCHEL MIXER to prepare the toner of the present invention.

Example 12

The procedure for preparation of the toner in Example 10 is repeated to prepare the toner of the present invention except for changing the purity content of the 4-methyl cinnamate to 0.1% by weight per 100% by weight of the solid content of the toner.

Example 13

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, the toner composition is included in the beaker, and stirred and emulsified for 3 min while an inner temperature of the beaker is maintained at 20° C. and a mixture therein is stirred by the T.K. HOMO MIXER from Tokushu Kika Kogyo Co., Ltd. at 12,000 rpm.

The mixture is included in a flask having a stirrer and a thermometer, and wherein the mixture is depressurized to 50 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake. The cake is further dispersed in distilled water so as to have a solid content of 10% by weight to prepare a dispersion.

An aqueous solution of 4-methyl sodium benzoate having a concentration of 1% is included in the dispersion such that a purity content of the 4-methyl benzoate is 0.3% by weight per 100% by weight of the solid content of the toner and stirred for 15 min to prepare a slurry, while a temperature of the dispersion is maintained at 20° C. and stirred. Further, an aqueous solution of a phosphoric acid having a normal concentration is included slowly in the dispersion to prepare a slurry having a pH of 4 while a temperature of the dispersion is maintained, and the slurry is stirred for 1 hr.

Further, 0.05% by weight of an aqueous solution including N,N,N,-trimethyl-[3-(4-perfluorononenyloxybenzamide) propyl]ammonium iodide, FUTARGENT from Neos, of 1% by weight is added to the slurry per 100% by weight of the solid content of the toner. Then, the slurry is filtered to prepare a cake and the cake is subjected to a reduced-pressure drying at 40° C. for 24 hrs to prepare a toner particle after stirred for 1 hr at room temperature. 0.5 parts of hydrophobic silica and 0.5 parts of hydrophobized titanium oxide are mixed with 100 parts of the toner particle by a HENSCHEL MIXER to prepare the toner of the present invention.

2Reparation of a Charge Controlling Agent Dispersion 2

10 parts of a di-tertiary butyl zinc salicylate salt, 100 parts of distilled water and 1 part of sodium dodecylbenzenesulfonate are dispersed in a closed pot by a ball mill using zirconia beads having a diameter of 5 mm for 24 hrs to prepare a charge controlling agent dispersion 2. The di-tertiary butyl zinc salicylate salt is all dispersed to have a particle diameter not greater than 1 μm.

Example 14

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, 1 part of an oil phase including the ketimine compound just before emulsified is included in the toner composition while an inner temperature of the beaker is maintained at 20° C. and a mixture therein is stirred by the T.K. HOMO MIXER from Tokushu Kika Kogyo Co., Ltd. at 12,000 rpm for 3 min to be emulsified.

The mixture is included in a flask having a stirrer and a thermometer, and wherein the mixture is depressurized to 50 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake. The cake is further dispersed in distilled water so as to have a solid content of 10% by weight to prepare a dispersion.

An aqueous solution of 4-trifluoromethyl sodium benzoate having a concentration of 1% is included in the dispersion such that a purity content of the 4-trifluoromethylbenzoate is 0.03% by weight per 100% by weight of the solid content of the toner and stirred for 15 min to prepare a slurry, while a temperature of the dispersion is maintained at 20° C. and stirred. Further, an aqueous solution of a phosphoric acid having a normal concentration is included slowly in the dispersion to prepare a slurry having a pH of 4 while a temperature of the dispersion is maintained, and the slurry is stirred for 1 hr.

Further, the charge controlling agent dispersion 2 is added to the slurry while stirred such that di-tertiary butyl zinc salicylate salt has a purity content of 0.3% by weight per 100% by weight of the solid content of the toner. Then, the slurry is filtered to prepare a cake and the cake is subjected to a reduced-pressure drying at 40° C. for 24 hrs to prepare a toner particle after stirred for 1 hr at 20° C. 0.5 parts of hydrophobic silica and 0.5 parts of hydrophobized titanium oxide are mixed with 100 parts of the toner particle by a HENSCHEL MIXER to prepare the toner of the present invention.

Example 15

The procedure for preparation of the toner in Example 10 is repeated to prepare the toner of the present invention except for changing the 4-methyl sodium cinnamate to 4-methyl sodium benzoate.

Example 16

The procedure for preparation of the toner in Example 10 is repeated to prepare the toner of the present invention except for changing the 4-methyl sodium cinnamate to 4-methylphenoxy sodium acetate.

Example 17

The procedure for preparation of the toner in Example 10 is repeated to prepare the toner of the present invention except for changing the 4-methyl sodium cinnamate to 2-chlorophenoxy sodium acetate.

Synthesis of Particulate Resin 683 parts of water, 11 parts of a sodium salt of an adduct of a sulfuric ester with ethyleneoxide methacrylate (ELEMINOL RS-30 from Sanyo Chemical Industries, Ltd.), 138 parts of styrene, 83 parts of methacrylate, 55 parts of tetrafluoroethyl methacrylate and a 1 part of persulfate ammonium are mixed in a reactor vessel including a stirrer and a thermometer, and the mixture is stirred for 15 min at 400 rpm to prepare a white emulsion therein. The white emulsion is heated to have a temperature of 75° C. and reacted for 5 hrs. Further, 30 parts of an aqueous solution of persulfate ammonium having a concentration of 1% are added thereto and the mixture is reacted for 5 hrs at 75° C. to prepare an aqueous dispersion a of a vinyl resin (a copolymer of a sodium salt of an adduct of styrene-methacrylate-tetrafluoroethyl methacrylate-sulfuric ester with ethyleneoxide methacrylate). The particulate resin dispersion liquid is measured by LA-920 from Horiba, Ltd. to find a volume-average particle diameter thereof was 0.25 μm.

Example 18

The procedure for preparation of the toner in Example 14 is repeated to prepare the toner of the present invention except for changing the charge controlling agent 2 to the particulate resin dispersion liquid to have a solid content of 1.0% by weight per 100% by weight of the solid content of the toner.

Comparative Example 4

200 parts of the ethyl acetate solution of the polyester resin, 5 parts of carnauba wax and 4 parts of Copper Phthalocyanine Blue are dispersed in a closed pot by a ball mill using zirconia beads having a diameter of 5 mm for 24 hrs to prepare a toner composition. 600 parts of ion-exchanged water, 60 parts of tricalcium phosphate and 3 parts of sodium dodecylbenzenesulfonate are uniformly dissolved and dispersed in a beaker. Then, 1 part of an oil phase including the ketimine compound just before emulsified is included in the toner composition while an inner temperature of the beaker is maintained at 20° C. and a mixture therein is stirred by the T.K. HOMO MIXER from Tokushu Kika Kogyo Co., Ltd. at 12,000 rpm for 3 min to be emulsified.

The mixture is included in a flask having a stirrer and a thermometer, and wherein the mixture is depressurized to 50 mm Hg (absolute) and reacted for 8 hrs to remove a solvent. The ethylacetate therein is 100 ppm when measured by a gas chromatography. Then, the mixture is cooled to have a room temperature, and 120 parts of a concentrated hydrochloric acid having a concentration of 35% is included therein to dissolve the tricalcium phosphate. After the mixture is stirred at room temperature for 1 hr, the mixture is filtered to prepare a cake. The cake is dispersed again in distilled water and filtered, which is repeated three times to wash the cake.

The cake is further dispersed in distilled water so as to have a solid content of 10% by weight to prepare a dispersion. A temperature of the dispersion is increased to 50° C., an aqueous solution of zinc sulfate having a concentration of 1% is added thereto while stirred such that the zinc has a purity content of 0.3% by weight per 100% by weight of the solid content of the toner, and the dispersion is stirred for 15 min. Further, an aqueous solution of sodium hydrate having a concentration of 1% is added to the dispersion so as to have a pH of 10 while the temperature thereof is maintained at 50° C. After 15 minutes stir, the temperature of the dispersion is increased to 85° C. and an aqueous solution of a sodium salt of 3,5-di-tertiarybutyl salicylate having a concentration of 1% is dropped therein while the temperature thereof is maintained such that 3,5-di-tertiarybutyl salicylate has a purity content of 0.79% by weight per 100% by weight of the solid content of the toner, and the dispersion is stirred for 1 hr to prepare a slurry. Then, the slurry is filtered to prepare a cake and the cake is subjected to a reduced-pressure drying at 40° C. for 24 hrs to prepare a toner particle after stirred for 1 hr at 20° C. 0.5 parts of hydrophobic silica and 0.5 parts of hydrophobized titanium oxide are mixed with 100 parts of the toner particle by a HENSCHEL MIXER to prepare a comparative toner.

Then, the slurry is filtered to prepare a filtered liquid, and a pH thereof is reduced to 2 with a hydrochloric acid to find that an amount of the carboxylic acid separated out is almost same as that of the carboxylic acid included in the slurry. The carboxylic acid is scarcely reacted.

Comparative Example 5

The procedure for preparation of the toner in Example 10 is repeated to prepare a comparative toner except that the pH of the slurry is not controlled after the carboxylic acid derivative is included therein and is 8.

Then, the slurry is filtered to prepare a filtered liquid, and a pH thereof is reduced to 2 with a hydrochloric acid to find that an amount of the carboxylic acid separated out is almost same as that of the carboxylic acid included in the slurry. The carboxylic acid is scarcely reacted.

Comparative Example 6

The procedure for preparation of the toner in Example 10 is repeated to prepare a comparative toner except that the aqueous solution of a phosphoric acid is all at once included in the dispersion.

Then, the resultant slurry is filtered to prepare a filtered liquid, and a pH thereof is reduced to 2 with a hydrochloric acid to find that an amount of the carboxylic acid separated out is almost same as that of the carboxylic acid included in the slurry. The carboxylic acid is scarcely reacted.

Evaluation of the Toner 5 parts of the toner and 95 parts of the following carrier are mixed with a blender for 10 min to prepare a developer.

A silane coupling agent and a silicone resin are dispersed in toluene to prepare a dispersion. The dispersion is sprayed on a core material formed of a spherical particulate ferrite having an average particle diameter of 50 μm, and the spray-coated core material is fired and cooled to prepare a particulate carrier having an average resin-coated thickness of 0.2 μm.

A) Chargeability

The developer is put in a stainless pot in a laboratory at 20° C. and 50% RH, and the stainless pot is rotated at a specific revolution. After the stainless pot is rotated for 15 sec, a charge quantity (μc/g) of the developer is measured with an blowoff.

B) Saturated Charge Quantity

Similarly to the above-mentioned method, after the stainless pot is rotated for 10 min, a charge quantity (μc/g) of the developer is measured with an blowoff.

C) Saturated Charge Quantity in an Environment of High Temperature and High Humidity The developer is put in a stainless pot in a laboratory at 30° C. and 90% RH, and the stainless pot is rotated at a specific revolution. After the stainless pot is rotated for 10 min, a charge quantity (μc/g) of the developer is measured with an blowoff.

D) Thin Line Reproducibility

A tandem full-color copy, wherein an intermediate transferer and an amorphous silicon photoreceptor being positively charged is used, continuously produces 100,000 images having an image occupancy of 7% with papers RICOH 6000 from Ricoh Company, Ltd. and the developer. The thin line images on the 30,000$^{th}$ image and 100,000$^{th}$ image are observed with an optical microscope of 100 magnifications, and compared with a level specimen to evaluate quality of the thin line images at 4 levels. The quality thereof is higher in the following order:

◎>○>Δ>X wherein X represents a level which is not acceptable as a product.

E) Fixable Temperature Range

After 30,000 images are produced, full-color solid images are produced at a fixing roller surface temperature of from 120 to 200° C., and the toner on the images is transferred onto an adhesive tape to compare transfer levels thereof with a 4-level specimen. A minimum fixable temperature is a temperature at which the transfer level is less than a standard, and a maximum fixable temperature is a temperature at which glossiness of the image begins to decrease. The fixable temperature range is a temperature therebetween.

The evaluation results are shown in Table 1.

TABLE 1

| | A) | B) | C) | D) (100,000/30,000) | E) |
|---|---|---|---|---|---|
| Example 1 | 20.3 | 33.5 | 30.3 | ◎/◎ | 80 |
| Example 2 | 22.2 | 36.8 | 33.1 | ◎/◎ | 80 |
| Example 3 | 12.5 | 24.5 | 21.6 | ○/◎ | 75 |
| Example 4 | 30.9 | 33.8 | 29.2 | ◎/○ | 75 |
| Example 5 | 39.2 | 46.2 | 39.3 | ◎/◎ | 70 |
| Example 6 | 17.3 | 27.1 | 22.7 | ○/○ | 80 |
| Example 7 | 21.5 | 34.2 | 32.4 | ◎/◎ | 80 |
| Example 8 | 15.8 | 27.4 | 22.4 | ○/○ | 80 |

TABLE 1-continued

| | A) | B) | C) | D) (100,000/30,000) | E) |
|---|---|---|---|---|---|
| Example 9 | 25.1 | 30.5 | 27.4 | ◎/◎ | 75 |
| Example 10 | −25.3 | −32.5 | −30.3 | ◎/◎ | 80 |
| Example 11 | −28.2 | −35.8 | −31.5 | ◎/◎ | 80 |
| Example 12 | −22.5 | −23.3 | −20.8 | ◎/◎ | 85 |
| Example 13 | −31.5 | −33.8 | −31.2 | ◎/◎ | 55 |
| Example 14 | −42.2 | −48.2 | −41.2 | ○/◎ | 40 |
| Example 15 | −22.3 | −28.3 | −25.6 | ○/◎ | 80 |
| Example 16 | −24.5 | −30.2 | −28.2 | ◎/◎ | 80 |
| Example 17 | −15.8 | −31.8 | −31.4 | ◎/◎ | 80 |
| Example 18 | −25.8 | −30.5 | −31.5 | ○/◎ | 75 |
| Comparative Example 1 | +7.5 | −15.2 | −10.5 | X/Δ | 80 |
| Comparative Example 2 | +3.3 | +8.5 | 5.3 | X/X | 75 |
| Comparative Example 3 | +7.2 | +6.3 | −4.3 | X/X | 60 |
| Comparative Example 4 | +8.1 | −15.0 | −9.6 | X/X | 15 |
| Comparative Example 5 | −5.3 | −18.5 | −21.3 | X/Δ | 75 |
| Comparative Example 6 | +7.2 | −16.3 | −9.3 | X/Δ | 60 |

As the evaluation results show, the surface treatment of the present invention, wherein a carboxyl group on a surface of a toner is connected with a carboxyl group of an aromatic compound by hydrogen bonding, can impart quite good chargeability to the toner. Further, the toner produces quality images and has good fixability.

In addition, a developing method, a transfer method and a process cartridge producing quality images can be provided, when the toner is therefor.

This application claims priority and contains subject matter related to Japanese Patent Application No. 2004-001077 filed on Jan. 6, 2004, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of preparing a toner in an aqueous medium, comprising:

preparing a dispersion or an emulsion of a toner composition comprising a resin having at least one carboxyl group and a colorant, wherein the dispersion or emulsion of toner particles has a pH of from 1 to 7; and mixing an aqueous solution of an aromatic compound having a carboxyl group with the dispersion or emulsion, such that the at least one carboxyl group of the resin on a surface of the toner is connected with the carboxyl group of the aromatic compound by hydrogen bonding;

to provide said aromatic compound having a carboxyl group only on the surface of the toner.

2. The method of claim 1, wherein the preparing step further comprises:

dissolving or dispersing the toner composition in a polymerizing monomer to prepare a toner composition liquid; dispersing the toner composition liquid in an aqueous medium comprising water and a surfactant to prepare an emulsion; and subjecting the emulsion to a polymerization reaction to prepare the dispersion or emulsion of the toner composition.

3. The method of claim 1, wherein the method further comprises:

in said preparing step, dispersing a toner composition comprising a resin having at least one carboxyl group and a colorant in an aqueous medium using a surfactant to prepare a dispersion of the toner composition;

after said mixing step, agglomerating particles in the dispersion or emulsion of the toner composition; and fusing the agglomerated toner composition particles to one another.

4. The method of claim 1, wherein the method further comprises:

in said preparing step, dissolving or dispersing a toner composition comprising a resin having at least one carboxyl group and a colorant in an organic solvent to prepare a toner composition liquid; and dispersing the toner composition liquid in an aqueous medium including a surfactant to prepare an emulsion; and after said mixing step, removing the organic solvent from the emulsion to prepare a dispersion or emulsion of toner particles.

5. The method of claim 1, wherein the method further comprises:

in said preparing step, dissolving or dispersing a toner composition comprising a resin having at least one carboxyl group and a colorant in an organic solvent to prepare a toner composition liquid; and dispersing the toner composition liquid in an aqueous medium comprising water and a surfactant to prepare a first emulsion;

after said mixing step, subjecting the first emulsion to a polyaddition reaction to prepare a second emulsion; and removing the organic solvent from the second emulsion after or during the polyaddition reaction.

6. The method of claim 5, wherein the polyaddition reaction is performed using an isocyanate-terminated compound.

7. The method of claim 1, wherein the aromatic compound having a carboxyl group is a member selected from the group consisting of compounds having one of the following formulae (1) to (6):

(1)

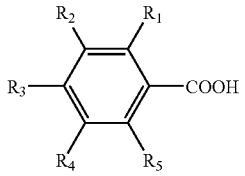

wherein $R_1$ and $R_5$ each, independently, represent an alkyl group having 1 to 12 carbon atoms, an aryl group, a methoxy group, an ethoxy group, a hydrogen atom, a carboxyl group or a hydroxyl group; and $R_2$, $R_3$ and $R_4$ each, independently, represent a halogen atom, a perfluoroalkyl group, a fluoro group, a nitro group, a carboxyl group or a hydrogen atom, and at least one of $R_2$, $R_3$ and $R_4$ is a member selected from the group consisting of a halogen atom, a perfluoroalkyl group, a fluoro group and a nitro group;

(2)

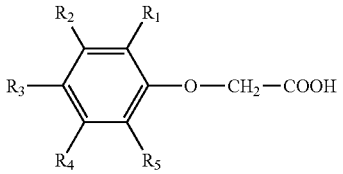

wherein $R_1$ and $R_5$ each, independently, represent an alkyl group having 1 to 12 carbon atoms, an aryl group, a methoxy group, an ethoxy group, a hydrogen atom, a carboxyl group or a hydroxyl group; and $R_2$, $R_3$ and $R_4$ each, independently, represent a halogen atom, a perfluoroalkyl group, a fluoro group, a nitro group, a carboxyl group or a hydrogen atom, and at least one of $R_2$, $R_3$ and $R_4$ is a member selected from the group consisting of halogen atom, perfluoroalkyl group, fluoro group and nitro group;

(3)

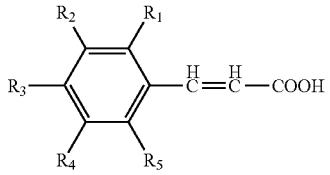

wherein $R_1$ and $R_5$ each, independently, represent an alkyl group having 1 to 12 carbon atoms, an aryl group, a methoxy group, an ethoxy group, a hydrogen atom, a carboxyl group or a hydroxyl group; and $R_2$, $R_3$ and $R_4$ each, independently, represent a halogen atom, a perfluoroalkyl group, a fluoro group, a nitro group, a carboxyl group or a hydrogen atom, and at least one of $R_2$, $R_3$ and $R_4$ is a member selected from the group consisting of halogen atom, perfluoroalkyl group, fluoro group and nitro group;

(4)

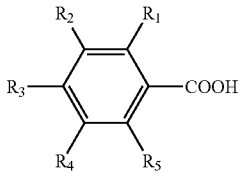

wherein $R_1$ and $R_5$ each, independently, represent a halogen atom, a perfluoroalkyl group, a fluoro group, a vitro group, a carboxyl group or a hydrogen atom; and $R_2$, $R_3$ and $R_4$ each, independently, represent an alkyl group having 1 to 12 carbon atoms, an aryl group, a methoxy group, an ethoxy group, a hydrogen atom, a carboxyl group or a hydroxyl group;

(5)

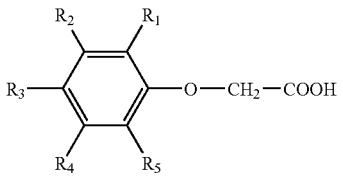

wherein $R_1$ and $R_5$ each, independently, represent a halogen atom, a perfluoroalkyl group, a fluoro group, a nitro group, a carboxyl group or a hydrogen atom; and $R_2$, $R_3$ and $R_4$ each, independently, represent an alkyl group having 1 to 12 carbon atoms, an aryl group, a methoxy group, an ethoxy group, a hydrogen atom, a carboxyl group or a hydroxyl group;

(6)

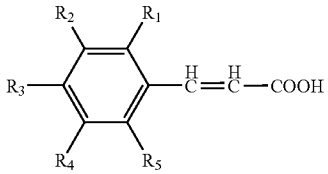

wherein $R_1$ and $R_5$ each, independently, represent a halogen atom, a perfluoroalkyl group, a fluoro group, a nitro group, a carboxyl group or a hydrogen atom; and $R_2$, $R_3$ and $R_4$ each, independently, represent an alkyl group having 1 to 12 carbon atoms, an aryl group, a methoxy group, an ethoxy group, a hydrogen atom, a carboxyl group or a hydroxyl group.

8. The method of claim 1, wherein the carboxyl group of the aromatic compound is a member selected from the group consisting of a sodium carboxylate group, a potassium carboxylate group and a lithium carboxylate group.

9. The method of claim 1, further comprising heating the dispersion or emulsion of the toner composition.

10. The method of claim 1, further comprising, after said mixing step, mixing a fluorochemical surfactant with the dispersion or emulsion.

11. The method of claim 10, wherein the fluorochemical surfactant is a compound having the following formula (7):

(7)

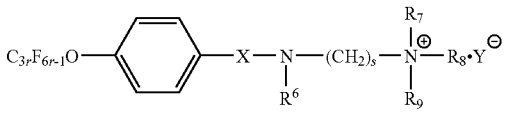

wherein X represents —$SO_2$ or —CO—; $R_6$, $R_7$, $R_8$ and $R_9$, each, independently, represent a hydrogen atom, a lower alkyl group having 1 to 10 carbon atoms or an aryl group; Y represents I or Br; and r and s each, independently, represent an integer of from 1 to 20.

12. The method of claim 1, further comprising, after said mixing step, mixing a quaternary ammonium cation containing fluorochemical surfactant with the dispersion or emulsion.

13. The method of claim 12, wherein the quaternary ammonium cation fluorochemical surfactant is a compound having the following formula (8):

(8)

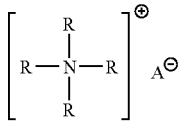

wherein each R independently represents an alkyl group having 3 to 20 carbon atoms or a hydrogen atom, and wherein at least one R is an alkyl group having 3 to 20 carbon atoms; and A represents an anion.

14. The method of claim 1, further comprising, after said mixing step, mixing a charge controlling agent with the dispersion or emulsion.

15. The method of claim 1, further comprising, after said mixing step, mixing an organic particulate material having a volume-average particle diameter of from 0.01 to 1.0 μm with the dispersion or emulsion.

16. The method of claim 1, further comprising, after said mixing step, mixing a fluidizer with the dispersion or emulsion.

* * * * *